US005101728A

United States Patent [19]

Frink

[11] Patent Number: 5,101,728

[45] Date of Patent: Apr. 7, 1992

[54] PRECISION GUIDED MUNITIONS ALTERNATOR

[75] Inventor: Richard C. Frink, Norwich, N.Y.

[73] Assignee: Simmonds Precision Products, Inc., Tarrytown, N.Y.

[21] Appl. No.: 552,889

[22] Filed: Nov. 17, 1983

[51] Int. Cl.[5] ..... F42C 11/04

[52] U.S. Cl. ..... 102/209

[58] Field of Search ..... 102/209, 208

[56] References Cited

U.S. PATENT DOCUMENTS

| | | | |
|---|---|---|---|
| 3,747,529 | 7/1973 | Plattner | 102/209 |
| 3,994,228 | 11/1976 | Hurlimann | 102/209 |
| 4,004,519 | 1/1977 | Hopkins | 102/208 |
| 4,005,658 | 2/1977 | Karayannis | 102/209 |
| 4,214,533 | 7/1980 | Fine et al. | 102/209 |

*Primary Examiner*—Charles T. Jordan

*Attorney, Agent, or Firm*—Edwin E. Greigg; Ronald E. Greigg

[57] ABSTRACT

An alternator assembly for use with munitions fired from rifled bores in which both the rotor and stator are juxtaposed along the axis of the munition member and do not exceed the bore-size diameter of the member. Electrical energy is thus generated as the member or round traverses the bore, which energy is used for powering a munition tracking system and/or arming a fuse contained therein.

13 Claims, 1 Drawing Sheet

FIG 1
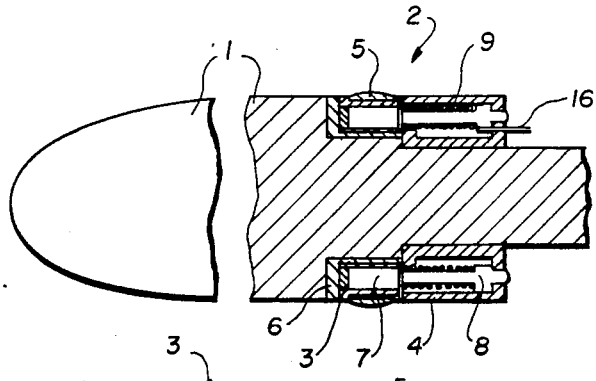
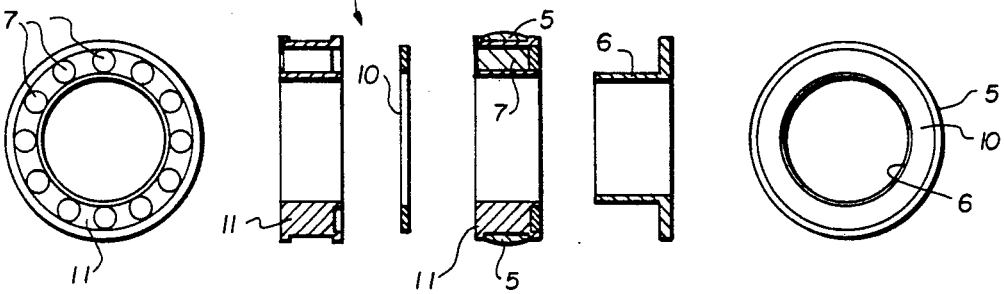
FIG 2
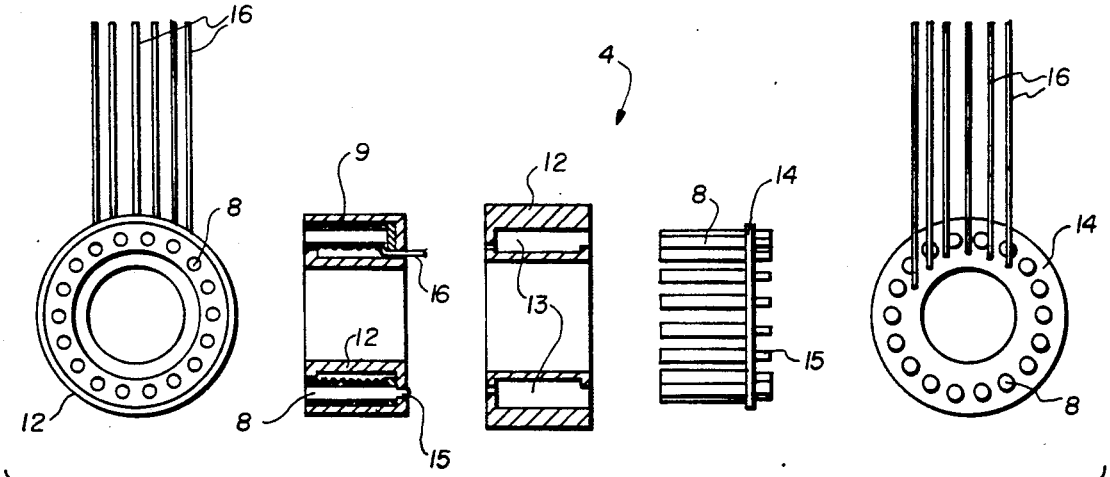
FIG 3
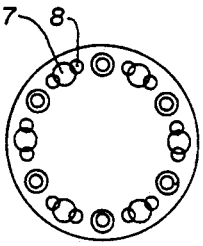
FIG 5
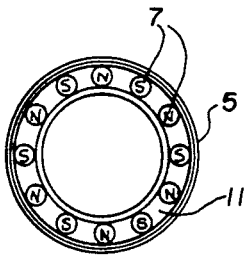
FIG 4

PRECISION GUIDED MUNITIONS ALTERNATOR

BACKGROUND OF THE INVENTION

The present invention relates to alternator structures for munitions in general and artillery projectiles in particular which are fired from a rifled bore and have a spin signature in order to provide electrical energy for guidance of the projectile or for arming the fuse. Heretofore alternator structures were used with non-spin projectiles such as mortars, bombs, and rockets in which velocity in flight was used as a separate spin signature. Such alternators are designed with an air duct assembly or vanes which respond to an air stream for imparting a rotary motion to the rotor assembly of the alternator device. There exists, however, a need for confining an alternator assembly within the confines of a rifled bore of a gun of from 35 mm to 40 mm, completely contained in the round to be fired and which can sustain severe acceleration and high gravity forces in the course of being fired from such guns and at the same time provide electrical power immediately upon the emergence of the round from the gun barrel in order to power an internal guidance system for precision guided munitions.

SUMMARY OF THE INVENTION

The present invention provides an annular alternator assembly for precision guided munitions that is suitable for mass production and that can survive severe acceleration and gravitational forces, for example, 65,000 G's minimum gravitational force and 7.6 million radians per second squared acceleration forces, as well as rotational speeds of 85,000 rpm.

The alternator according to the invention is brought up to speed by a nylon sleeve on the rotor that follows the rifling of the bore of the gun barrel. The rotor itself is mounted on a graphite sleeve bearing provided on the shell or round such that sufficient spin in imparted to the rotor during firing so that the alternator can continue to provide full power for a minimum of at least five seconds after it, together with the round, leaves the gun barrel.

The alternator itself, according to the invention, comprises two separate sections, the rotor and the stator, which are mounted adjacent each other along the long axis of the round so that both are juxtaposed rather than concentrically mounted with respect to each other; thus the construction of the alternator assembly advantageously uses the generally elongated dimensions of the projectile round.

The rotor is formed by a cast, non-magnetic housing into which are positioned a circular array of permanent magnets, Samarium cobalt magnets, for example, alternating their north and south poles. The magnets are held in place by a magnetic washer which is force fitted to one end of the housing while the other end receives a graphite cylindrical sleeve having an endface corresponding to the washer and therebetween defines a bobbin-like structure that rotably supports the rotor against the graphite endface.

The stator, on the other hand, is cast in a solid magnetic material comprising a stator core assembly of a circular array of pole members with two separate three-phase windings. The stator core is contained by a retaining cup in which are riveted the pin-like extensions of the pole members.

The invention will be better understood and further objects and advantages thereof will become more apparent from the ensuing detailed description of preferred embodiments taken in conjunction with the drawings.

BRIEF DESCRIPTION OF THE DRAWINGS

FIG. 1 is a sectional view of the complete alternator assembly according to the invention;

FIG. 2 is schematic exploded view of the rotor assembly according to the invention;

FIG. 3 is a schematic exploded view of the stator assembly according to the invention;

FIG. 4 is an end plan view illustrating the arrangement of the rotor magnets;

FIG. 5 illustrates the relationship between the rotor magnetics and the stator poles when juxtaposed in the completed assembly.

DETAILED DESCRIPTION

Referring now to FIG. 1 there is shown a munitions shell or round 1 which it is assumed is to be fired from a rifled bore of from 35 to 45 mm in diameter, not shown, although it is within the scope of the invention to have a larger bore used with the alternator 2, since the larger dimensions can accommodate greater tolerances between the various parts of the alternator assembly according to the invention. As shown, the alternator assembly 2 is confined within the outer circumference of the munitions shell 1. Toward the forward end of the shell is the rotor assembly 3 containing a circular array of permanent magnets 7 and around which is fitted a nylon sleeve 5 which projects just slightly beyond the circumference of the rotor and the shell so that it, the nylon sleeve, is caused to follow the rifling of the bore as the round traverses the bore after being fired. Immediately following the rotor assembly, that is, juxtaposed therto, is the stator assembly 4 having a circular array of pole members 8 about which suitable windings 9 are wound. During firing of the round 1 the nylon sleeve 5 following the rifling of the bore of the gun brings the rotor up to speed, thus generating a voltage and hence an electrical current in the windings 9 surrounding the poles of the stator assembly, as is well known, which current is then fed by means of the leads 16 to a tracking device, not shown, contained within the munitions shell, which require electrical energy to operate, especially during the first five second after the round 1 has left the gun barrel. It is also within the scope of the invention to use such electrical energy as generated by the alternator according to the invention for the firing of a suitable fuse device, not shown, contained in the round.

In FIG. 2 is shown the various parts of the rotor assembly. A bearing 6, of graphite or other suitable material, is shown in the form of a bobbin with one endface removed and which is force fitted on an indented circumferential portion of the shell 1. A non-magnetic housing 11 is cast from a suitable material and has inserted therein a circular array of rare earth permanent magnets 7. The magnets are retained within the housing 11 by a washer 10 of magnetic material such as cold rolled steel. The washer 10 also provides a flux path between the ends of the magnet 7 adjacent the washer which is held in place by an interference or force fit with the inner rim of the housing 11. The nylon drive band 5 is bonded onto the outer rim of the cast housing, as shown. The entire rotor assembly is then mounted on the bearing sleeve 6 so that it is flush against the endface thereof, as shown in FIG. 1. During gun firing, the end of the rotor defined by the magnetic washer 10 rubs against the endface of the bearing 6, and the center portion of the rotor then rides on the cylindrical section of the bearing 6.

In FIG. 3 the stator assembly 4 is shown cast in a single piece of solid magnetic material, 8, 14, 15 such as cold rolled steel or ferrite which is coated with an insulating material, such as a fluidized bed coated epoxy. The stator poles 8, eighteen in number, that is, a pole positioned at every 20 degrees of rotations on said stator assembly, are wound with two separate three-phase windings 9. Six lead wires 16 are shown for accomodating the two three-phase windings which extend from suitably spaced holes in the endface of the retaining cup 12. Thus, the stator assembly 8, 14, 15 and windings 9 thereon are inserted in the retaining cup 12, the pins 15 on the one end of the stator being riveted to the endface of the cup 12 in the respective recepticles 13, as shown and potted with a suitable compound. The stator is thus restrained from moving due to the high G forces encountered during firing. Both the stator and rotor assembly are juxtaposed as shown in FIG. 1. A thin disc, not shown, can be provided for separating the two assemblies, that is, a disc of non-magnetic material sandwiched therebetween, such as phospher bronze or other suitable material which is non-magnetic and self lubricating to provide a minimum friction free interface.

FIG. 4 shows the arrangement of alternating permanent magnets 7 at the end of the rotor housing adjacent the stator assembly; thus the north and south poles alternate for the twelve magnets shown. Of course, it is within the scope of the invention to provide a lesser number of magnets, positioned for example at 45 degrees or 60 degrees or even 180 degrees of rotation on the rotor assembly rather than at 30 degrees, as shown. Also, the magnets are composed of samarium cobalt for generating electrical energy, although other permanent magnetic material may be used, depending on the amount of electrical energy desired.

FIG. 5 shows the angular relationship between the stator poles 8 and the alternating magnetic rotor poles 7 for generating a magnetic field. For example, one stator pole and one rotor pole are aligned coaxially at every 60 degrees of rotation, and therebetween each 60 degrees of rotation two stator poles are flux-linked with one rotor pole. Of course, with a lesser number of rotor poles, for example, one at every 90 degrees of rotation, a corresponding lesser number of stator poles could be employed, although the coil windings 9 in such cases would be accordingly increased. The arrangement as shown, however, has proven to be efficient as well as structurally sound for generating a maximum electrical energy output. Of particular importance is the strong construction of the stator assembly in which the coil windings are held rigidly in place by the eighteen-pole stator configuration in order to better withstand the severe gravitational, rotational and acceleration forces during firing.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. An alternator assembly power generator for use with munitons fired from guns having a rifled bore comprising, a munition member having a circumferentially indented portion diametrically smaller than a bore-size diameter of said member, a rotor assembly having permanent magnet means rotably mounted on said indented portion, the outer diameter of said rotor assembly corresponding to the bore-size diameter of said munition member, and a stator assembly having a coil winding means fixedly mounted on said indented portion and juxtaposed to said rotor assembly, the outer diameter of said stator assembly corresponding to the bore-size diameter of said munition member, whereby said rotor assembly is caused to rotate with respect to said stator assembly for generating an electrical current therein during the traversal of said munition member from a rifled bore.

2. An alternator assembly according to claim 1, wherein said stator assembly comprises a cast stator ring member of magnetic material defining a plurality of pole members extending therefrom in a direction parallel to the long axis of said munition member for supporting said coil winding means.

3. An alternator assembly according to claim 2, wherein a stator retaining cup member is provided for receiving said stator ring member, said ring member having a circular array of pin members for being riveted to an endface of said stator cup member.

4. An alternator assembly according to claim 1, wherein said rotor assembly comprises an annular housing rotably mounted on a graphite sleeve bearing surrounding said indented portion.

5. An alternator assembly according to claim 4, wherein said permanent magnet means comprises a plurability of rod-shaped magnets circumferentially spaced within said annular housing.

6. An alternator assembly according to claim 5, wherein said rod-shaped magnets are spaced at every 30 degrees of rotation of said rotor assembly and their respective north-south poles are alternatively arranged.

7. An alternator assembly according to claim 2, wherein said pole members are spaced circumferentially around said stator ring member every 20 degrees of rotation thereof.

8. An alternator assembly according to claim 3, wherein said coil-winding means comprises two separate three-phase windings.

9. An alternator assembly according to claim 8, wherein said two separate three-phase windings comprise six lead wires extending through respective holes in said stator ring member.

10. An alternator assembly according to claim 9, wherein said lead wires extend through said endface of said stator cup.

11. An alternator assembly according to claim 1, wherein said munition shell member has a diameter from approximately 35 mm to 40 mm.

12. An alternator assembly according to claim 1, wherein a disc of non-magnetic material is provided in the interface between said rotor assembly and said stator assembly.

13. An alternator assembly according to claim 4, wherein said annular housing is surrounded by a sleeve member whose diameter is approximately the same as the bore-size diameter of said munition member.

* * * * *